US009919442B2

(12) United States Patent
Robbins

(10) Patent No.: US 9,919,442 B2
(45) **Date of Patent: *Mar. 20, 2018**

(54) CONVERTIBLE SLICING/DICING MANDOLIN

(76) Inventor: Rodney W. Robbins, Florence, AL (US)

( * ) Notice: Subject to any disclaimer, the term of this patent is extended or adjusted under 35 U.S.C. 154(b) by 1447 days.

This patent is subject to a terminal disclaimer.

(21) Appl. No.: 12/931,844

(22) Filed: Feb. 11, 2011

(65) Prior Publication Data

US 2011/0132161 A1 Jun. 9, 2011

Related U.S. Application Data

(63) Continuation-in-part of application No. 12/562,333, filed on Sep. 18, 2009, now abandoned.

(51) Int. Cl.

| | |
|---|---|
| ***B26D 1/03*** | (2006.01) |
| ***B26D 3/18*** | (2006.01) |
| ***B26D 3/28*** | (2006.01) |
| ***B26D 7/26*** | (2006.01) |

(52) U.S. Cl.

CPC ..... *B26D 3/283* (2013.01); *B26D 1/03* (2013.01); *B26D 7/2628* (2013.01); *B26D 2003/285* (2013.01); *B26D 2003/287* (2013.01); *B26D 2003/288* (2013.01); *Y10S 83/932* (2013.01); *Y10T 83/04* (2015.04); *Y10T 83/8749* (2015.04); *Y10T 83/9493* (2015.04); *Y10T 83/9495* (2015.04); *Y10T 83/9498* (2015.04)

(58) Field of Classification Search

CPC ..... B26D 2003/288; B26D 1/02; B26D 1/03; B26D 3/283; B26D 7/2628; B26D 2003/285; B26D 2003/286; B26D 2003/287; A47J 43/25; Y10S 83/932; Y10S 83/954

USPC ..... 83/856, 858, 932

See application file for complete search history.

(56) References Cited

U.S. PATENT DOCUMENTS

| | | | | |
|---|---|---|---|---|
| 447,655 | A * | 3/1891 | Bew | 241/95 |
| 2,661,039 | A | 12/1953 | Davis et al. | |
| 2,766,793 | A * | 10/1956 | Duszynski | 83/699.51 |
| 3,091,269 | A | 5/1963 | Burns et al. | |
| 3,509,926 | A * | 5/1970 | Morris | 83/648 |

(Continued)

FOREIGN PATENT DOCUMENTS

| | | | |
|---|---|---|---|
| DE | 10 2009 030 851 | A1 * | 12/2010 |
| WO | WO 2005/097434 | A1 * | 10/2005 |

(Continued)

OTHER PUBLICATIONS de Buyer Brochure, Utensiles Pour La Gastronomie, 2009, 7 pgs.

(Continued)

*Primary Examiner* — Clark F Dexter

(57) ABSTRACT

The cutting device can be used to slice, make julienne strips, and/or dice food items. In dicing, preferably the horizontal slicer blade is retracted during a first pass of the slider past the julienne blades, and after the slider has been rotated by 90°, during a second pass, the horizontal blade is erected to make the horizontal cut and complete the dicing operation. A slicing width adjustment is provided with a large diameter threaded member being adjustable to support a movable platform, with an adjustable locking mechanism to support the end of the platform nearest the horizontal cutting blade.

6 Claims, 5 Drawing Sheets

(56) References Cited

U.S. PATENT DOCUMENTS

| | | | | |
|---|---|---|---|---|
| 3,664,396 | A | 5/1972 | Tremblay | |
| 4,062,260 | A | 12/1977 | Steinhogl | |
| 4,579,028 | A | 4/1986 | Neidhardt | |
| 5,745,999 | A * | 5/1998 | Zirkiev | 30/278 |
| 5,765,472 | A | 6/1998 | Kim | |
| D416,177 | S | 11/1999 | Hood | |
| 5,983,769 | A | 11/1999 | Schneider | |
| 6,401,605 | B1 | 6/2002 | Repac et al. | |
| 7,107,890 | B2 | 9/2006 | Vincent | |
| 7,690,285 | B2 | 4/2010 | de Buyer | |
| 7,837,137 | B2 | 11/2010 | Klotz et al. | |
| 8,096,218 | B2 * | 1/2012 | Klotz et al. | 83/352 |
| 2002/0174754 | A1 * | 11/2002 | Vincent | 83/247 |
| 2003/0126968 | A1 | 7/2003 | Baddepudi | |
| 2004/0231482 | A1 * | 11/2004 | Boilen | 83/425.3 |
| 2005/0061124 | A1 * | 3/2005 | Vincent | 83/247 |
| 2005/0229768 | A1 | 10/2005 | Buyer et al. | |
| 2005/0252387 | A1 | 11/2005 | Cornfield | |
| 2006/0075872 | A1 * | 4/2006 | Wangler | 83/856 |
| 2007/0095189 | A1 | 5/2007 | Williams | |
| 2007/0137457 | A1 * | 6/2007 | Botsai et al. | 83/858 |
| 2015/0231791 | A1 * | 8/2015 | Robbins | B26D 3/283 83/564 |

FOREIGN PATENT DOCUMENTS

| | | | |
|---|---|---|---|
| WO | WO 2005/097436 | A1 * | 10/2005 |
| WO | WO 2010/149372 | A1 * | 12/2010 |

OTHER PUBLICATIONS de Buyer Brochure, www.debuyer.com, Art De la Cuisine, 2009, 5 pgs.

Konstar 8 in 1 Super Slicer product literature (date unknown); see web page http://www.konstar.com.hk/product.php?id=99365.

* cited by examiner

FIG. 4
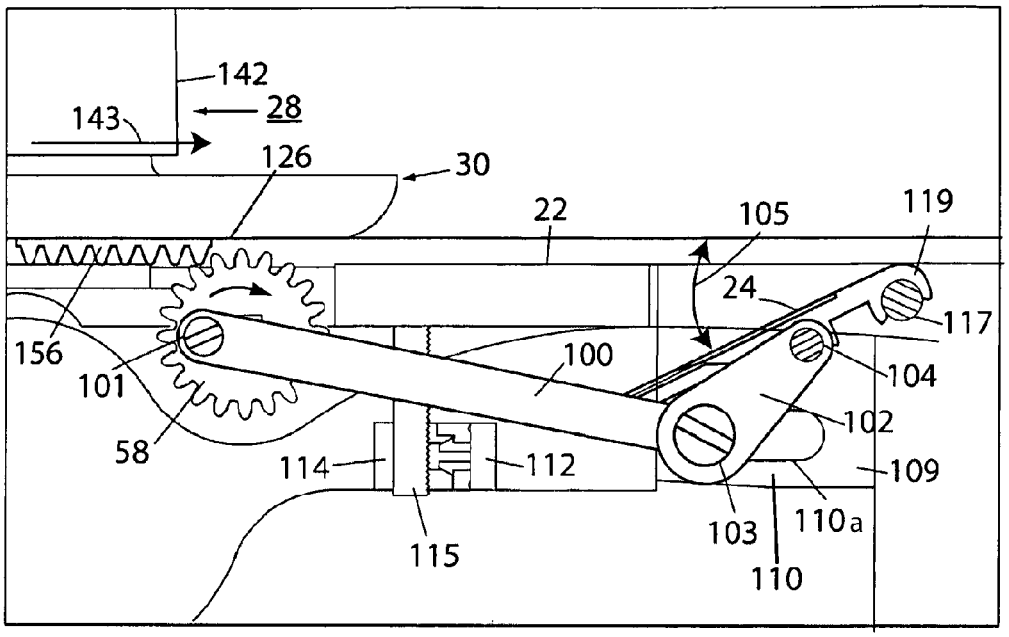
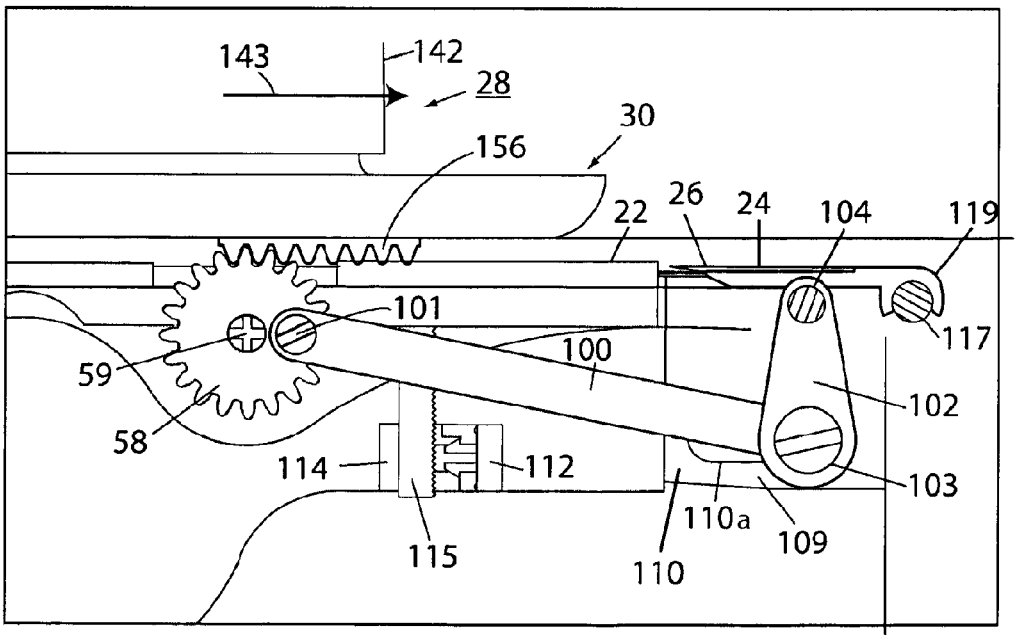
FIG. 5

CONVERTIBLE SLICING/DICING MANDOLIN

This application is a continuation in part of prior U.S. patent application Ser. No. 12/562,333 filed Sep. 18, 2009 (abandoned). The disclosure of that prior application hereby is incorporated herein by reference in its entirety.

This invention relates to devices and methods for slicing and/or dicing foods so as to make slices, strips ("juliennes") and dice foods. Such devices often are known as "mandolins."

Although mandolins are available at the present time, some of them are not entirely satisfactory, especially when used for dicing. Some such prior devices tend to jam and become temporarily inoperative, thus making them relatively slow and unreliable. In addition, prior mandolins tend to be relatively complex and expensive to manufacture.

Accordingly, it is an object of the present invention to provide a slicer/dicer mandolin and method in which the device is convertible to use for slicing, or making "juliennes" or strips, and/or for dicing, while overcoming or alleviating the defects discussed above.

In particular, it is an object to provide such a slicer/dicer and method of using it, which is relatively jam-free and consistently gives good quality slices, strips and dice. Furthermore, it is an object of the invention to provide such a device and method which is relatively simple to use and inexpensive to manufacture.

In accordance with the present invention, the foregoing objectives are met by the provision of a device and method for slicing and dicing foods having a support structure and a platform on the support structure for guiding a food item towards slicing blades, and a slider for pushing the food item towards the slicing blades.

One blade is parallel to the platform and one or more other blades are perpendicular to it. The parallel blade is mounted to be selectively moved out of the way so as to avoid cutting the food item, and subsequently is returned to cutting position.

The parallel (horizontal) blade is used alone to cut flat slices, or together with perpendicular julienne blades to cut strips. In a third mode, the dicing mode, the parallel blade is moved to an inoperative position during the first pass, and is returned to an operative position for a second pass, after the food item has been rotated 90° for dicing.

In one embodiment of the invention, the parallel blade has an operating mechanism which allows it to be moved out of the way and returned manually. In another embodiment, which is preferred, the slider has an engagement structure which engages a mechanism for moving the parallel blade out of the way automatically during a first pass, and then automatically engaging the mechanism a second time to restore the blade to its cutting position during a second pass, with the food item rotated by 90°, whereby foods are diced simply, reliably, and with little extra effort.

It is preferred that the engagement structure on the slider is detachable so that the mandolin is convertible from a dicer to one for use solely in either slicing or making strips.

In a preferred form, the automatic operating mechanism for the parallel or horizontal blade includes a rack and pinion arrangement, in which a rack is located on the slider, and the pinion drives a crank which alternatingly swings the parallel blade out of cutting position on one pass of the slider along the platform, and then swings the parallel blade into the path of the food item as it makes a second pass along the platform.

It is an advantage of the dicing mechanism and operation that the slider should be lifted off of the platform and rotated 90° to start the second pass, so that the food item will not be pushed backwardly through the julienne blades. This tends to minimize malfunctions.

Another advantageous feature of the invention is the provision of an adjustment mechanism for adjusting the height of the parallel blade above the platform to vary the thickness of slices cut by the parallel blade.

Preferably, a relatively large-diameter threaded member or plug is positioned below the platform as support. The threaded member mates with a threaded receptacle in the support structure, and the platform height can be adjusted by turning the threaded member.

Preferably, the diameter of the threaded member is more than half the width of the platform so as to provide support over a broad area.

Also preferably, at one end of the platform near the parallel blade, an adjustable lock is provided to give added vertical support to prevent unwanted sagging of the platform at any of the plurality of heights at which the platform may be set.

The foregoing and other objects and advantages of the invention will be described in or apparent from the following description and drawings.

IN THE DRAWINGS:

FIGS. 4 and 5 are partially schematic side elevation views illustrating the operation of the horizontal blade retraction and return mechanism of the present invention;

GENERAL DESCRIPTION

Figures 1, 1A:
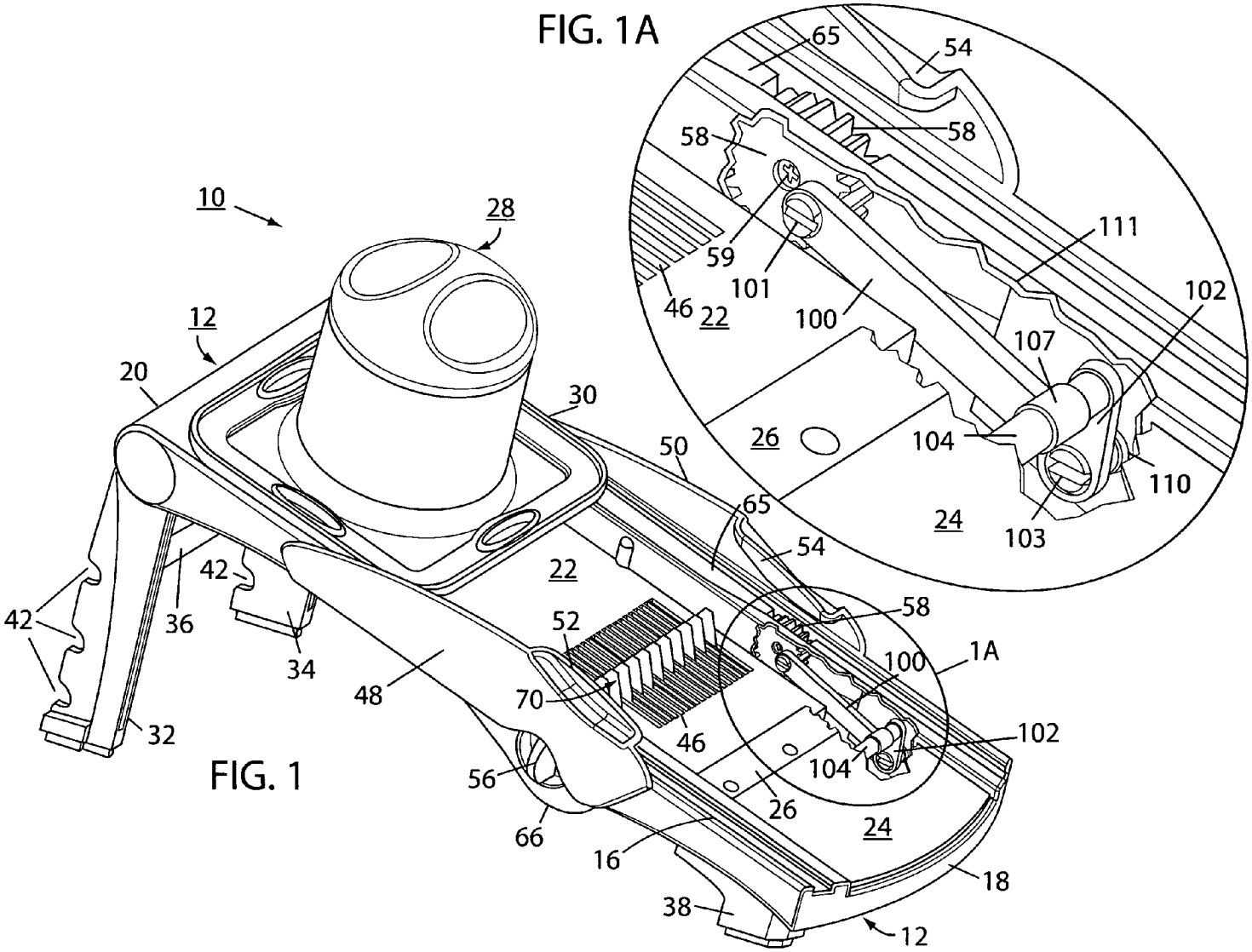
FIG. 1 is a perspective view of one embodiment of the present invention.
FIG. 1A is an enlarged perspective view of a portion of the structure in FIG. 1.

FIG. 1 shows a convertible cutting device or mandolin 10 which has a support structure including a frame 12 with side rails 14 and 16 and end portions 18 and 20. A platform 22 is mounted between the rails 14 and 16 so as to be vertically movable.

A horizontal blade support plate 24 has a horizontal cutting blade 26 secured to its front edge.

A plurality of slots 46 forms a grille 46 in the platform 22. A plurality of vertical blades ("julienne" blades) 70 extend upwardly through the slots 46.

A slider structure 28 is provided for holding a food item to be sliced. The slider has a rectangular- or square-shaped bottom 30 dimensioned to fit between the side-rails 14, 16 to guide the food item while it is moved downwardly along the platform and past the blade assembly 44 and blade 26 to slice the food.

The convertible device 10 is capable of operating in at least 3 modes as follows:

1. Operation Purely as a Horizontal Slicer.

The device can be operated purely as a horizontal slicer by twisting the knob 56 which is attached to the blades 70 so as to move all of them out of the way. The horizontal blade 26 is located at a predetermined distance above the platform so as to cut horizontal food slices of a predetermined thickness when the slider 28 is used to push the food item past the blade 26. This thickness can be adjusted, as it will be explained in greater detail below.

2. Operation to Form Julienne Strips.

If it is desired to operate the device to produce thin strips of the food item being sliced, the knob 56 is rotated to bring a desired set of julienne blades such as 70 to a vertical cutting position.

During one pass of the food item along the platform, first the julienne blades 70 make vertical cuts to a predetermined depth in the food item, and then the horizontal blade 26 makes a horizontal cut and the result is julienne food strips.

3. Dicing

When using the device 10 for dicing, the food item is moved in two passes past the blades 70 and 26.

During a first pass, the horizontal blade structure 24, 26 is pivoted downwardly so that the blade 26 is beneath the guide surface of the platform 22 and will not form a horizontal slice in the food item. Instead, only the julienne blades 70 make vertical cuts in the food item during the first pass.

The second pass of the food item is made after lifting (not sliding) the slider 28 up to the leading end 20 of the platform, and rotating the slider 90° from its initial position, and pushing the food item along the platform a second time. During this pass, the horizontal blade structure 24, 26 is pivoted upwardly to its cutting position. In this second pass, both the julienne blades 70 and the horizontal blade 26 cut the food item, with the julienne blades making a second cut, thus forming "dice." Although the dice can be cubes, they need not be, but can be rectangular parallelpipeds of a variety of sizes and shapes.

In the dicing mode of operation, the horizontal blade 26 makes only one cut during the two passes. Applicant has discovered that this is instrumental in making smooth and reliable cuts, and minimizing jamming. The dice are reliably shaped and relatively uniform for enhanced cooking characteristics and good looks.

In this dicing mode of operation, although the blade 26 may be pivoted up and down manually, it is preferred that the slider 28 itself is adapted to automatically cause the blade 26 to be retracted during the first pass, and automatically restored to its upward cutting position during the second pass.

Support Structure

Figure 2:
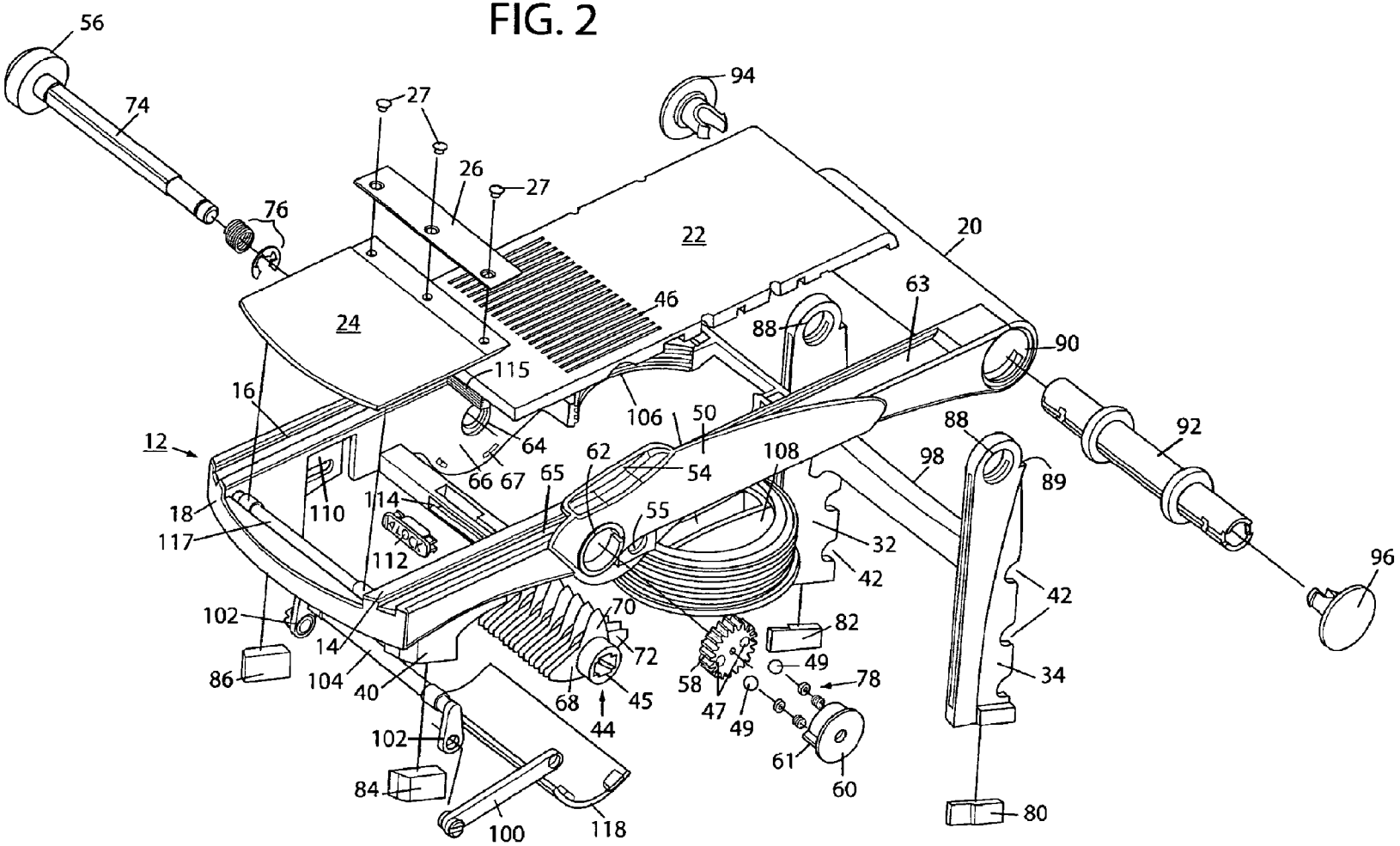
FIG. 2 is an exploded perspective view of the device shown in FIG. 1, without the slider mechanism.

Referring now to both FIGS. 1 and 2, the support structure includes the frame 12, and a pair of relatively long rear legs, 32 and 34, which are foldably attached to the frame 12 adjacent the rear portion 20 of the frame.

Referring specifically to FIG. 2, each of the legs 34 and 36 has a mounting hole 88 which mates with a hole 90 in the rear portion 20 of the frame, and an axle 92 passes through the holes 88 and 90 to rotatably mount the legs on the frame, with the assistance of snap-on caps 94 and 96 at the ends of the axle 92. A stop structure including a notch 89 in each leg holds the legs in the position shown in FIG. 1 during normal use of the mandolin structure.

Two short front legs 40 (FIG. 2) and 38 (FIG. 1) are provided so as to give the platform 22 a desired downward tilt with the rear legs 32, 34 extended as shown in FIG. 1.

Each of the rear legs 32 and 34 has a rubber foot 80 or 82, and rubber feet 84 and 86 are provided for the front legs 40 and 38 as well.

The rear legs have a plurality of notches 42 along of the lengths thereof. These notches can be used, when the legs are folded up, to rest on the edge of a bowl or other such container so as to use the mandolin over a receptacle for the cuttings.

Selectable Julienne Blades

FIG. 2 shows that the julienne blades 70 in FIG. 1 actually are part of an assembly 44 consisting of separate arrays of blades 68,70,and 72 with different spacings between them. Each of the arrays is located 90° from its nearest neighbor, with the bottom of the assembly having no blades.

The knob 56 is attached to the end of a square cross-section shaft 74 with a round end and a spring and lock washer 76 combination. The shaft 74 is inserted through a central hole in the assembly 44, with the square shaft engaging a rectangular hole 45 in the end of the assembly 44 to provide a driving connection between the knob 56 and the assembly 44. The round end of the shaft 74 extends through a hole 55 in the frame 12 in which it is rotatably mounted.

By turning the knob 56, any one of the three separate julienne blade arrays of blades 68, 70, or 72 can be brought to the upright position, and will be held there during cutting. Alternatively, the underside of the assembly 44 can be positioned upwardly so that no blades extend through the grille 46, when julienne cutting is not desired. A lock mechanism (not shown) is provided to hold the julienne blade assembly 44 in a fixed position once it has been selected, until it is released to allow the blade assembly 44 to rotate to a new position.

Horizontal Blade Actuation

The mounting and actuating mechanism for the retractable horizontal blade mechanism is shown in FIGS. 1, 1A, 2, 4, and 5.

Referring first to FIGS. 2, 4 and 5, the blade plate 24 with its blade 26 attached by plastic rivets 27 are mounted in the frame 12 by means of a horizontal rod 117 which is pivotably secured to the frame 12 at its opposite ends.

As it is shown thus in FIGS. 4 and 5, the blade plate 24 has a pair of integral plastic grippers 119 with flexible fingers which extend slightly more than half way around the rod 117 so as to be capable of being snapped onto the rod 117 and held firmly to the rod during operation, and yet be relatively easily pulled upwardly to remove and replace the plate 24 with another blade platform having a different blade, such as a crinkle-cut blade (not shown).

The assembly of the platform 22 and the rod 117 swing freely about the two pivot points so that the blade plate 24 will fall downwardly under the force of gravity unless it is supported from below.

For the sake of clarity, it should be explained that, in FIG. 5, the platform 22 is shown at a position above the blade 26, a position it takes when the device 10 is not in use. When the device 10 is in use, the platform 22 will be adjusted downwardly so that the blade 26 is above the platform by a pre-determined distance, the pre-determined distance determining the thickness of the slices cut by the blade.

Also, it should be understood that there is a stop projection at 111 in FIG. 1A (not shown in FIG. 4 or 5) which limits the upward motion of the blade 26 and brings it to a consistent stopping position whenever it is raised.

Referring now to FIGS. 1 and 1A, 2, 4 and 5, the mechanism provided for raising and lowering the plate 24 and its blade 26 through the arc 105 (FIG. 4) is described as follows:

A pinion gear 58 is mounted to rotate in the frame by means of an insert 60 (FIG. 2) which fits into a hole 62 in the frame 12. A spline 61 is provided to fit into a slot on the inside wall of the hole 62 to properly align the insert 60 in the hole.

The pinion 58 is rotatably mounted by means of a plastic-push fastener 59 (FIG. 5) on the insert 60.

Referring again to FIG. 2, the pinion 58 has two indentations 47 on its surface facing the insert 60, and two ball bearings 49 and sets of springs and washers 78 are provided to form a detent so that the rotation of the pinion through 180° causes a noticeable "click" and a stop position to indicate when the pinion has reached one of two desired positions.

As shown in FIGS. 1A, 4 and 5, mounted in the frame 12 is a slotted plate 110 having a slot 110*a*. Another plate 110 is shown in FIG. 2, which is an extra in case a second actuating mechanism is needed.

A crossbar 104 is provided which extends parallel to the pivot bar 117. At each end of the bar 104 is a cam 102 with a large end attached to a crank arm 100 by means of a snap-in pin 103. The pin 103 extends through the slot 110*a* in the plate 110 so that the lower end of the cam 102 slides horizontally in the slot 110*a*.

As shown in FIGS. 1A, 4 and 5, the crank arm 100 is rotatably fastened to the pinion 58 at an off-center point by a push-pin fastener 101.

FIG. 4 shows the mechanism in the position at which it comes to rest at the end of the first pass of a dual-pass dicing operation. The blade plate 24 is positioned downwardly at its lowest position, and the pinion 58 has been rotated to the position shown.

FIG. 5 shows the position of the blade plate 24 and the blade 26 in an upward cutting position to which it has been moved by rotation of the pinion 58 clockwise. In this position, the pin 103 has been pushed horizontally to the right to the far end of the slot 110*a* in the plate 110 so that the upper end of the cam 102 and the bar 104 have been raised to the vertical position as shown in FIG. 5, thereby supporting the plate 24 and the blade 26 in a position ready for cutting when the platform 22 is positioned below the blade 26.

Although the pinion 58 can be reached and operated by hand to raise and lower the plate 24, it is preferred that an engagement structure in the form of a rack 156 on the slider 28 is used to rotate the pinion 58.

The slider 28 is shown in FIGS. 4 and 5 moving from left to right in the direction of the arrow 143, as it would move during the second pass of a two-pass dicing operation.

Thus, the rack 156 meshes with and rotates the pinion 58 to raise the plate 24 and the blade 26 to a 17, cutting position, before the food item inside of the slider 28 reaches the blade so that the blade is in proper position for cutting when the food item reaches the blade.

As it will be explained in greater detail below, the slider 28 is equipped with the racks 156 located symmetrically on all four of its sides so that it can be rotated 90° between the first and second passes of the dicing operation to consistently engage and drive the pinion 58. This has the further advantage that use of the slider does not require any one orientation at the start of its use, whether or not it is used for dicing.

Each of the racks has a length just sufficient to rotate the pinion 58 half of one revolution, and is positioned so as to ensure the revolution is complete before the food item in the slider 28 reaches the blade 26.

Referring now to FIGS. 1 and 2, advantageously, overhanging flanges 52 and 54 are provided over the area where the pinion is located. Those flanges provide passages just slightly higher than the bottom 30 of the slider 28 so as to hold the bottom 30 down and provide positive engagement between the rack 156 and the pinion 58.

Also, the slot or groove in which one of the racks 156 travels when moving down the platform 22 has a wide upper end 63 and a narrower lower end 65. The wide upper end 63 makes it easier to insert the rack 156 into the groove, but the lower end precisely guides the rack 156 to its desired location.

Cylindrical plastic extensions 107 (see FIG. 1A) are provided around the shaft 104 and rod 117 to provide bearing surfaces for the parts which are attached at those locations.

Slider Construction

Figure 3:
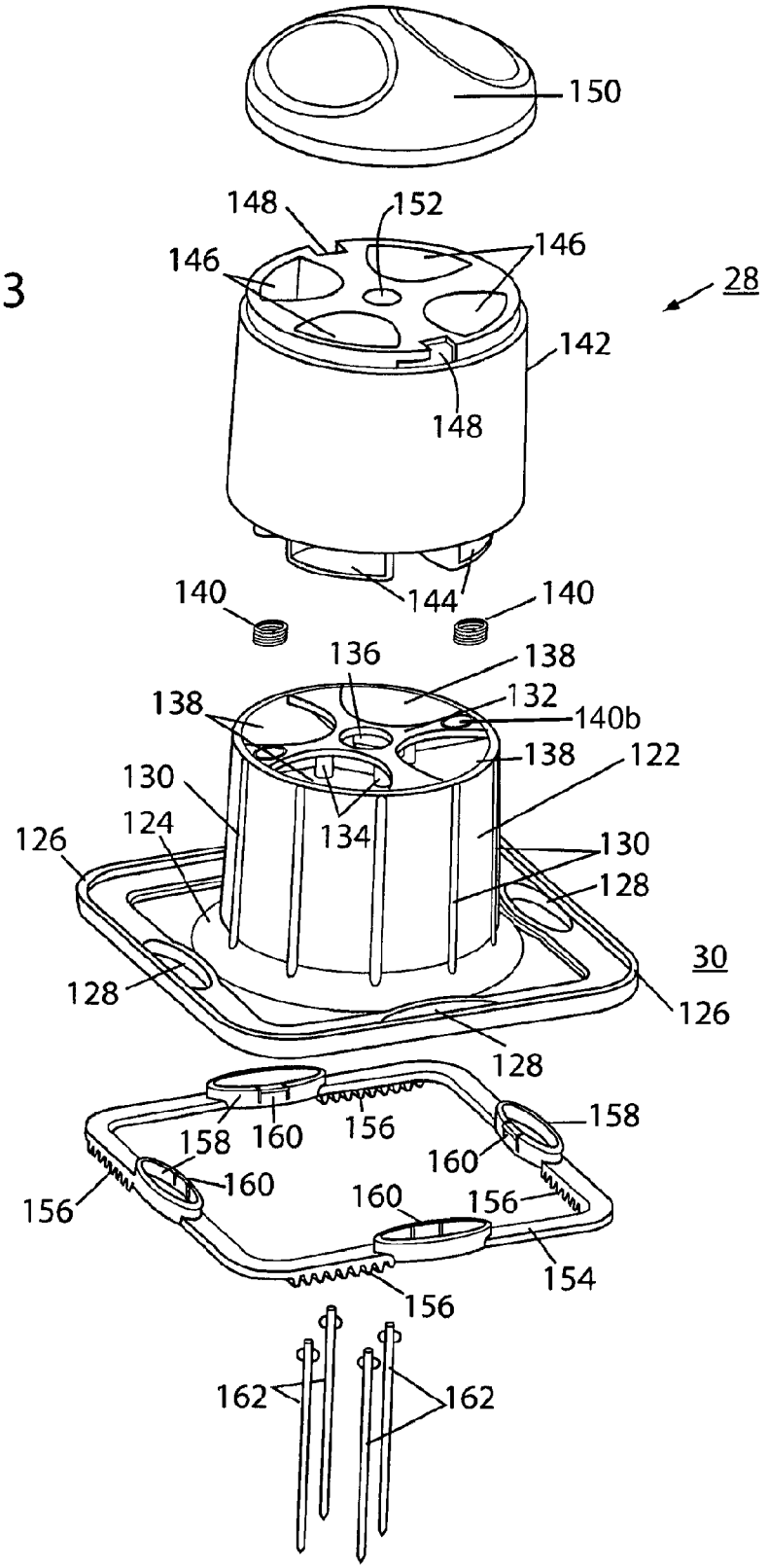
FIG. 3 is an exploded perspective view of the slider mechanism of the present invention.
Figure 6:
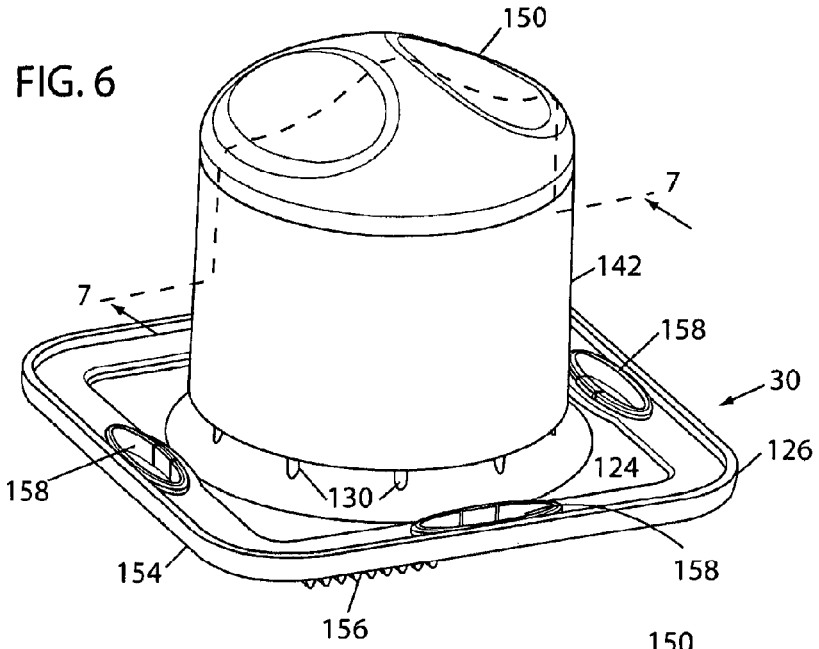
FIG. 6 is perspective view of the slider shown in FIGS. 1 and 3.
Figure 7:
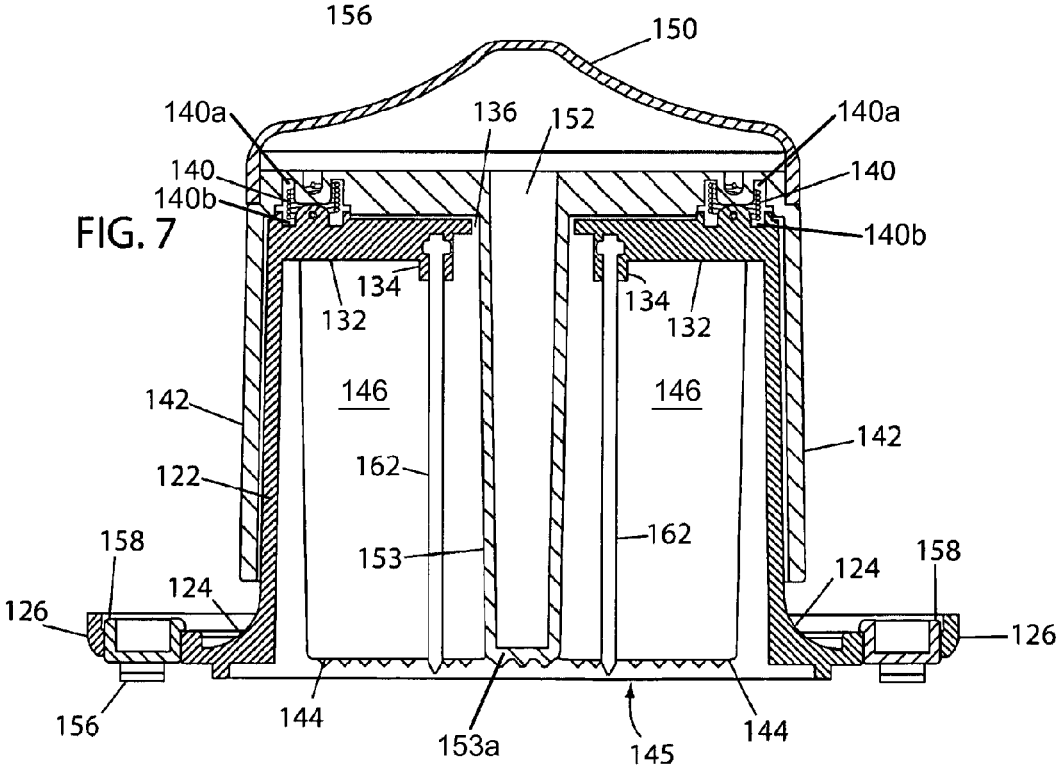
FIG. 7 is a cross-sectional view taken along line 7-7 of FIG. 6.

Referring now to FIGS. 3, 6 and 7, as well as FIG. 1, the slider 28 consists of an inner food-holding cylinder 122 with outwardly extending vertical ribs 130, and an outer cylinder 142 dimensioned to fit downwardly over and slide on the cylinder 122 to press downwardly on a food item inside of the inner cylinder 122. Actually, the cylinders 122 and 142 are slightly tapered and thus are slightly frusto-conical.

The inner cylinder 122 has a lower flange 124 to which is secured a square frame 126 having four oval-shaped apertures 128.

The apertures 128 are shaped to receive oval vertical extensions 158 from a ring 154 (see FIG. 3) which has four symmetrically spaced racks 156 extending downwardly from the ring 154.

Referring now to FIG. 3, the inner cylinder 122 has a top portion 132 with a cross-like shape. It has a large central hole 136 and four much larger openings 138 between the central hole and the outer wall of the inner cylinder 122.

Four bosses 134 receive and hold four co-molded steel spears or stakes 162 (see FIG. 7) which are used to impale and hold the food item in the inner cylinder 122.

The outer cylinder 142 has four vertical molded pusher extensions 146 whose bottom walls 144 are shown in FIGS. 3 and 7. A central hole 152 is the entrance of an elongated tube 153 (FIG. 7). As it is shown in FIG. 7, the bottom walls 144 of the extensions 146 and the bottom wall 153*a* of the two-portioned 153 have small, pointed projections to better grip the food item being pushed by the structure.

A cap 150 is fastened to the outer cylinder 142 by means of screw-in lugs (not shown) mating with receptacles 148 as shown in FIG. 3.

The oval projections 158 from the ring 154 have flexible plastic tabs 160 which cooperate with the openings 128 in the frame 126 to snap the projections into the oval openings 128 when the ring 154 is pressed upwardly to attach it to the rest of the slider structure 28.

The ring 154 can easily be removed simply by pulling downwardly on the ring at the four locations of the oval projections 158 to release them from the openings 128 so that the slider 28 can be used without the rack structure 156.

As is shown in FIGS. 3 and 7, two extension springs 140 are mounted in recesses 140*a* in the top wall of the outer cylinder 142 and recesses 140*b* the top wall 132 of the inner cylinder 122 so as to hold the outer cylinder 142 close to the inner cylinder when the outer cylinder is not being pressed downwardly by the person using the slider 28. This helps prevent the top portion from wobbling too much during the handling of the slider 28, such as between the first and second steps of the dicing operation.

In use, with the outer cylinder 142 removed, a food item is inserted into the large opening 145 (see FIG. 7) of the inner cylinder 122 and is impaled on the spears 162 to hold it in place.

As an example, a potato or a portion of a potato can be impaled on the spears 162 to make it ready for slicing.

Then, the outer cylinder 142 is placed over the inner cylinder 122 and the pushers 146 push downwardly on the top of the food item to urge it into a position to be sliced at the bottom.

Then, the slider is positioned at the top or left hand portion of the platform 20, as shown in FIG. 1, and is pushed down the inclined platform towards the blades. As each slice removed from the bottom reduces the height of the food item, the hand pressure on the outer cylinder 142 presses the pushers 146, 153, etc. down and this moves the food item into position for another cut.

Blade Height Adjustment

In accordance with one feature of the present invention, a unique blade height adjustment means is provided for the horizontal or parallel blade 26.

Referring to FIG. 2, a large-diameter threaded cylindrical plug 108 is provided to mate with similar threads 106 in the support structure 12. The diameter of the plug is selected to be relatively large, and is preferably larger than one half the width of the platform 22 so as to cover a large surface area and serve as a stable support for the platform 22, and particularly for the rear and central portions of the platform.

In accordance with another advantageous feature of the invention, an adjustable locking structure is provided to support the forward end of the platform 22 nearest the cutting blade 26. This structure is shown in FIGS. 2, 4 and 5. The locking structure includes a cross-bar 114, a serrated vertical riser 115, and a sliding locking member 112. When an adjustment of the threaded plug 108 is made so that the platform is located at a different height relative to the fixed position of the blade 26, the lock structure is actuated to adjust the support provided by the riser 115 to the front portion of the platform 22. Specifically, referring to FIG. 2, the lock element 112 is slid to the right to disengage it from the riser 115, and the riser 115 is moved upwardly or downwardly to adjust to the new position of the platform. Then, the lock member 112 is slid to the left so that its structure engages with the serrated teeth of the surface of the riser 115 to hold it locked in position at the new location.

Thus, the combination of the large threaded plug 108 and the locking mechanism 112, 114, 115 provide a relatively easy and simple means of adjusting the height of the platform 22 and, therefore, the thickness of the cut made by the blade 26.

Materials

To the extent possible, it is preferred that the device 10 be made of molded plastic materials which are tough, durable, washable, dishwasher-safe and relatively inexpensive.

Cutting blades, such as the blade 26, the ball bearings 49, spears 162, and lock washers preferably are made of stainless steel or similar corrosion-resistant metal.

The rubber feet 80, 82, 84 and 86 can be made of silicone rubber or any other suitable moldable rubber material.

The above description of the invention is intended to be illustrative and not limiting. Various changes or modifications in the embodiments described may occur to those skilled in the art. These can be made without departing from the spirit or scope of the invention.

The invention claimed is:

1. A convertible food slicer comprising:

a. a support structure;

b. at least a first food slicing blade and a plurality of second food slicing blades mounted on said support structure;

c. a platform mounted on said support structure and having a guide surface defining a path for guiding a movement of a food item towards and past said first and second slicing blades;

d. a slider structure for holding said food item and for guiding said food item along said guide surface past said first and second slicing blades;

e. said first slicing blade having a cutting edge, said cutting edge being substantially parallel to said guide surface when said first slicing blade is in a first position spaced above said guide surface by a predetermined distance for cutting a slice from said food item;

f. said first slicing blade being pivotably mounted on said support structure so as to be selectively movable between said first position and a second position spaced from said first position and away from said guide surface;

g. said second slicing blades each having a cutting edge that is orthogonal to said cutting edge of said first blade when said second slicing blades are disposed in said path to cut said food item;

h. a control element operatively connected to said first blade, said control element being rotatable for selectively pivoting said first blade between said first position and said second position; and i. an engagement structure on said slider for engaging and moving said control element and thereby pivoting said first blade from said first position to said second position upon a first movement of said slider past said first and second blades in a first direction, and pivoting said first blade from said second position to said first position upon a second movement of said slider past said first and second blades in the same direction.

2. A food slicer as in claim 1 in which said engagement structure comprises a rack on said slider, said control element comprising a mating pinion mounted on said support structure to engage with said rack, a crank mechanism driven by said pinion and connected to a cam engaging said first blade to move said first blade to said second position upon said rack traversing said pinion once, and to move said first blade back to said first position upon said rack traversing said pinion a second time in the same direction.

3. A food slicer as in claim 2 in which said support structure includes a hold-down flange positioned to hold said rack down to prevent disengagement of said rack from said pinion during travel of said slider past said pinion.

4. A food slicer as in claim 1 in which said platform is pivotably mounted on said support structure independently of said first blade, and further comprising an adjustment mechanism for adjusting a vertical position of said platform relative to said first blade so as to adjust a vertical spacing between said guide surface of said platform and said cutting edge of said first blade while assuring that said cutting edge of said first blade is substantially parallel to said guide surface of said platform at all positions to which said platform is adjusted so as to slice said food item so that it has a desired thickness.

5. A food slicer as in claim 1 in which said slider has a substantially square base and said engagement structure comprises a rack on each of at least two sides of said base whereby said engagement structure is operative both with said slider in a first rotational orientation and a second rotational orientation approximately 90° from said first rotational orientation.

6. A food slicer as in claim 5 in which each of said racks is removably attached to said slider, whereby said food item can be cut into slices selected from the group consisting of flat one-piece slices and strips, when said racks are removed, and cubes, when said racks are attached.

* * * * *